US006211632B1

(12) United States Patent
Liao

(10) Patent No.: US 6,211,632 B1
(45) Date of Patent: Apr. 3, 2001

(54) DIRECTION CONTROL DEVICE FOR A CEILING FAN

(75) Inventor: Yin-Sheng Liao, Taichung Hsien (TW)

(73) Assignee: Rhine Electronic Co., Ltd., Taichung (TW)

( * ) Notice: Subject to any disclaimer, the term of this patent is extended or adjusted under 35 U.S.C. 154(b) by 0 days.

(21) Appl. No.: 09/392,003

(22) Filed: Sep. 8, 1999

(51) Int. Cl.[7] ..... H02K 9/04; F04D 25/08; H04Q 7/06

(52) U.S. Cl. ..... 318/16; 318/257; 318/280

(58) Field of Search ..... 318/16, 256, 257, 318/280, 287, 291, 293; 310/62, 63; 340/825.71, 825.72; 416/5; 417/44.1, 423.14

(56) References Cited

U.S. PATENT DOCUMENTS 5,340,277 * 8/1994 Whitaker ..... 416/5
5,738,496 * 4/1998 Mehta ..... 417/44.1
6,015,274 * 1/2000 Bias et al. ..... 417/423.1

* cited by examiner

*Primary Examiner*—Bentsu Ro
(74) *Attorney, Agent, or Firm*—William E. Pelton, Esq.

(57) ABSTRACT

A direction control device for a ceiling fan is disclosed, which has a remote receiver arranged inside a canopy of the ceiling fan and a direction control circuit unit arranged in a switch box of the ceiling fan. The conducting wires of the remote receiver and the connection lines of the fan motor are both electrically connected to the direction control circuit unit via a hanger rod of the ceiling fan without being redirected and the rotation direction of the ceiling fan can be remotely controlled.

5 Claims, 3 Drawing Sheets

DIRECTION CONTROL DEVICE FOR A CEILING FAN

BACKGROUND OF THE INVENTION

1. Field of the Invention

The present invention relates to the field of ceiling fan, more particularly, to a direction control device for a ceiling fan.

2. Description of Related Art

The ceiling fan has been widely used to provide cooling function as well as decorative effect. Because the ceiling fan is secured to ceiling and suspended therefrom, it may have remote control capability so that a user can conveniently control the operation of the ceiling fan. Such a remote control operation is accomplished by using a remote controller to transmit wireless signal to the ceiling, which is received by the receiver of the ceiling to control the operation states thereof.

FIG. 3 shows a ceiling fan which has a canopy (83), a motor (80), a hanger rod (82) suspended from the canopy (83) and extended through the motor (80), a plurality of blades (81) connected to the motor (80) and a switch box (84) secured to the bottom of the hanger rod (82). The switch box (84) has a pull chain (85) to be used to manually control the operation of the ceiling fan.

In case that such a ceiling fan is provided with remote control and rotation direction control capabilities, a remote receiver and a direction control device are both installed in the canopy (83). Although the space inside the canopy (83) is large enough to accommodate the receiver and the direction device, the process to install is difficult. As the direction control to the motor (80) is accomplished by switching the power connection lines thereof, the connection lines of the motor (80) have to be connected to the switch box (84) such that the operation of the motor (80) can be controlled by the pull chain (85), and then redirected to the switch box (84) via the hanger rod (82). The hanger rod (82) is hollow to receive electrical wires or the like. However, the inner diameter of the hanger rod (82) is usually so small such that the connection wires of the motor (80) are difficult to extended therethrough. Particularly, the connection wires have to be manually extended through the hanger rod (82), which results in difficulty in assembly of a ceiling fan. Therefore, there is a need for the above ceiling fan control device to be improved.

SUMMARY OF THE INVENTION

The object of the present invention is to provide a direction control device which can be easily installed into a ceiling fan.

To achieve the object, a direction control device is provided to have a remote receiver arranged inside a canopy of the ceiling fan and a direction control circuit unit arranged in a switch box of the ceiling fan. The conducting wires of the remote receiver and the connection lines of the fan motor are both electrically connected to the direction control circuit unit via a hanger rod of the ceiling fan without being redirected and the rotation direction of the ceiling fan can be remotely controlled.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
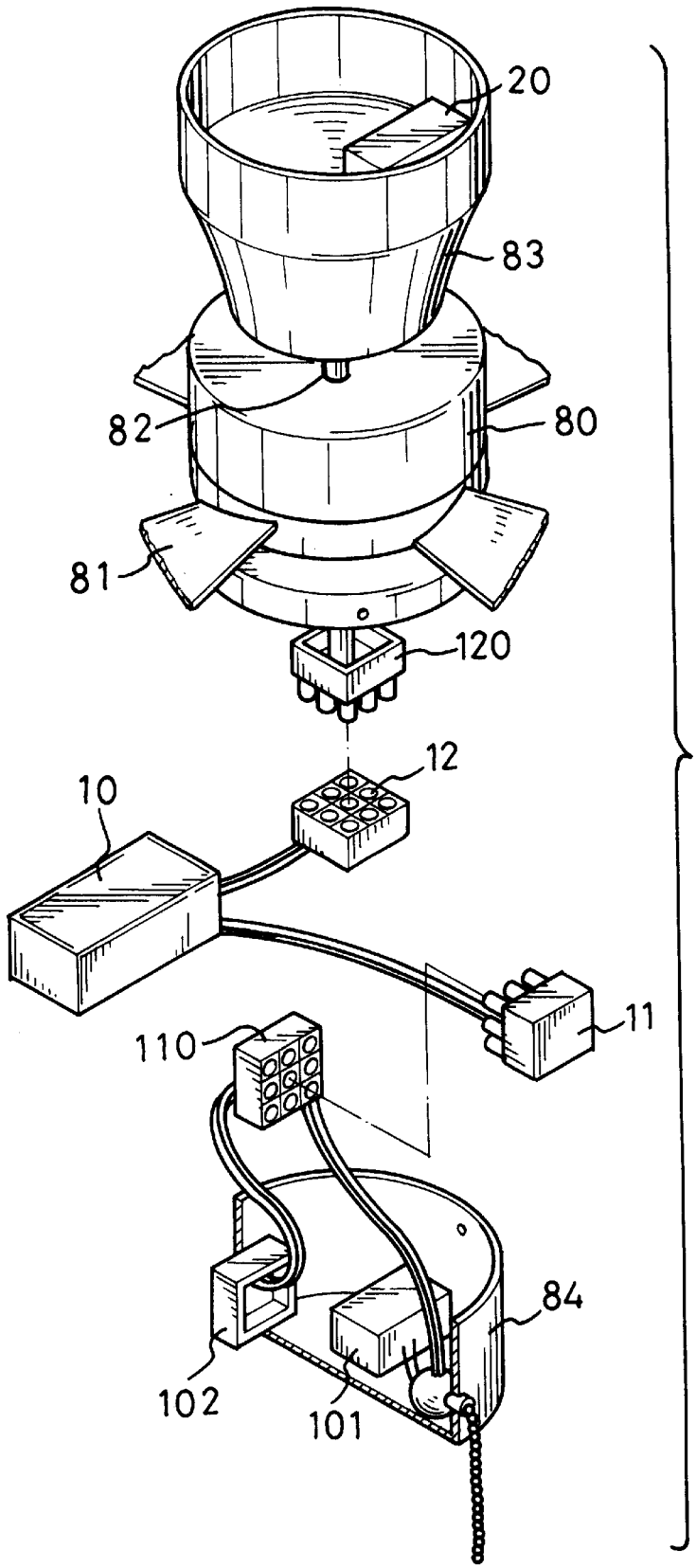
FIG. 1 is a partially exploded view of a ceiling fan that is installed with a direction control device in accordance with the present invention.

FIG. 1 is a partially exploded view of a ceiling fan that is installed with a direction control device in accordance with the present invention, wherein only the parts of a ceiling fan related to the direction control, such as the switch box (84), canopy (83) and hanger rod (82), are illustrated. The switch box (84) has a manually operated direction controller (102) and a manually operated switch device (101) activated by a pull chain to manually control the operation of the ceiling fan. A direction control circuit unit (10) is provided to electrically connect with the manually operated direction controller (102) and switch device (101). Further, the direction control circuit unit (10) is electrically connected with the connection lines of the motor and conducting wires of the remote receiver (20), both extended through the hanger rod (82). In this preferred embodiment, the direction control circuit unit (10) is connected to a female connector (12) and a male connector (11), respectively. The manually operated direction controller (102) and switch device (101) are both connected to a female connector (110). The connection lines of the motor and conducting wires of the remote receiver (20) are extended from the canopy (83) and connected to a male connector (120). With the arrangement of such connectors (11, 12, 120, 110), the male connectors 120 and 11 are plugged into the female connectors 12 and 110, respectively, to implement the circuit connection of the ceiling fan for controlling the operation thereof, in which the direction control circuit unit (10) is connected to the manually operated switch device (101), the manually operated direction controller (102), and the conducting wires and connection lines extended from the hanger rod (82).

Figure 2:
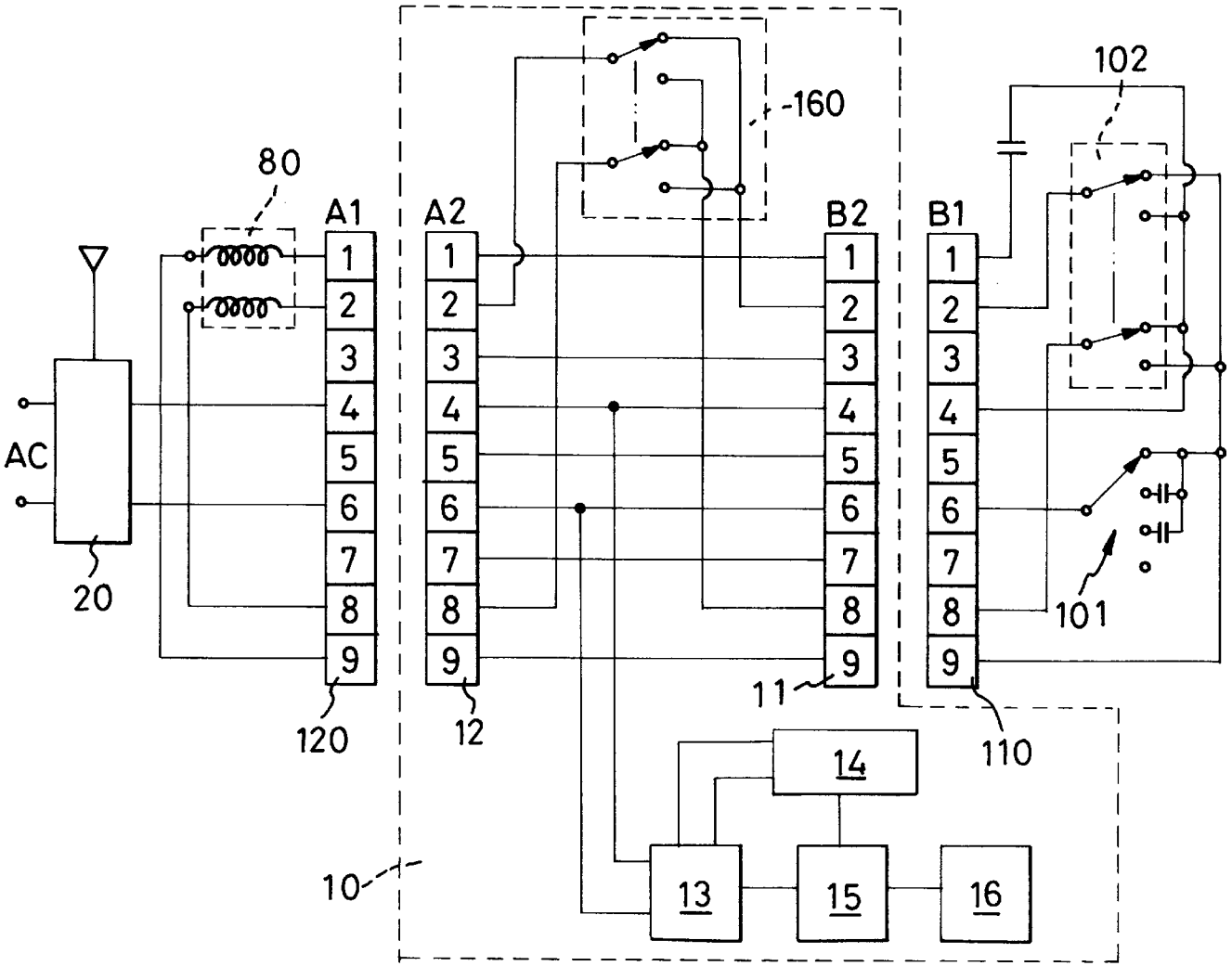
FIG. 2 is a schematic diagram showing the circuit arrangement of the direction control device in accordance with the present invention.
Figure 3:
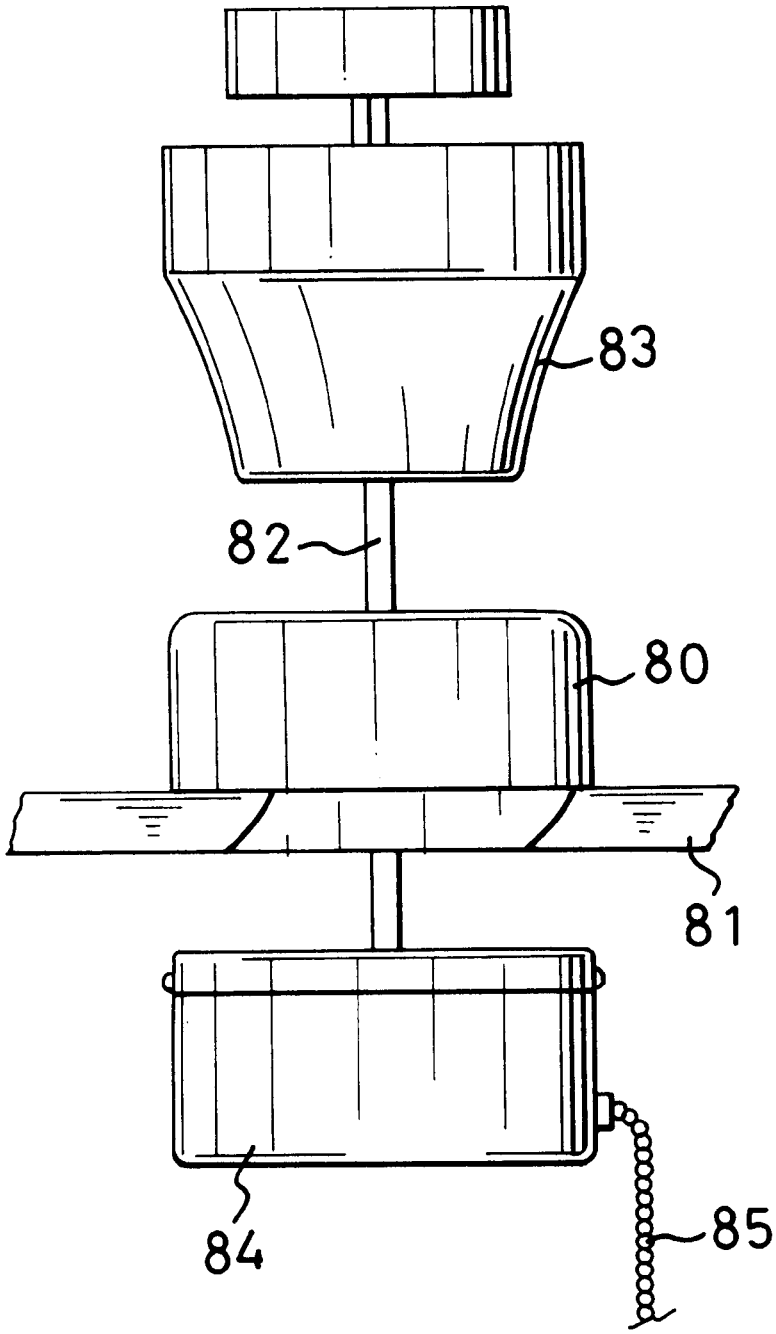
FIG. 3 PRIOR ART
FIG. 3 is a plain view of a conventional ceiling fan.

With reference to FIG. 2, the direction control circuit unit (10) has a power circuit (13) for supplying power thereto via the female connector (12), a detect circuit (14) for sensing signal received by the remote receiver (20), a microprocessor (15) connected to the detect circuit (14) for receiving control signal therefrom, and a relay drive circuit (16) controlled by the microprocessor (15).

The female connector (12) has multiple sockets (numbered from 1 to 9) for receiving the pins (also numbered from 1 to 9) of the male connector (120), respectively, such that signals, including the power lines and the control signals from the remote receiver (20) in the canopy (83), can be directed to the female connector (12) and transferred to other components.

The power circuit (13) is capable of voltage rectifying and regulating to provide a working voltage to the direction control circuit unit (10).

The detect circuit (14) is used to sense the signals sent out by the remote receiver (20), including an acknowledgement signal periodically generated in normal condition and the received control signal, which are sent to the microprocessor (15) to activate the relay drive circuit (16).

The relay drive circuit (16) is provided to control a switch circuit (160) having two relay switches operated synchronously. The two relay switches are connected to the two coils of the motor (80), input power, manually operated switch device (101) and direction controller (102) via the male and female connectors (11, 12, 120, 110), respectively. When the relay drive circuit (16) is activated, the two relay switches make changes in switching states at the same time to change the direction of the current in the coils of the motor (80) thereby making a change in the rotation direction of the motor (80).

With the structure of the ceiling fan as described above, a user can always control the operation of the motor (80) by the manually operated switch device (101). In addition, when the user makes a change to the rotation direction of the ceiling fan by a remote control, the remote receiver (20) in the canopy (83) receives the control signal and sends it to the direction control circuit unit (10). Accordingly, the microprocessor (15) of the direction control circuit unit (10) is operated to activate the relay drive circuit (16) to synchronously change the states of the two relay switches of the switch circuit (160) thereby changing the power line connection of the motor (80) such that the rotation direction of the motor is changed.

Because of the direction control device in accordance with the present invention and the remote receiver (20) are respectively installed in the switch box (84) and the canopy (83), instead of being installed together, the motor connection is not required to be redirected to the canopy (83) to provide the ceiling fan with both of the remote control and rotation direction control capabilities. Therefore, the assembly process for the ceiling fan is easier.

Although the present invention has been explained in relation to its preferred embodiment, it is to be understood that many other possible modifications and variations can be made without departing from the spirit and scope of the invention as hereinafter claimed.

What is claimed is:

1. A direction control device for a ceiling fan having a canopy (83), a motor (80), a hanger rod (82) suspended from said canopy (83) and extended through the motor (80) and a switch box (84) secured to the bottom of the hanger rod (82), said direction control device comprising:

a remote receiver (20) arranged inside said canopy (83); and a direction control circuit unit (10) arranged in said switch box (84);

wherein said remote receiver (20) having conducting wires and said motor (80) having connection lines both electrically connected to said direction control circuit unit (10) via said hanger rod (82) without being redirected so that the rotation direction of said ceiling fan can be remotely controlled.

2. The direction control device for a ceiling fan as claimed in claim 1, wherein said switch box (84) has a manually operated direction controller (102) and a manually operated switch device (101) electrically connected to said direction control circuit unit (10).

3. The direction control device for a ceiling fan as claimed in claim 2, wherein said direction control circuit unit (10) is connected to a first female connector (12) and a first male connector (11) which are plugged with a second male connector (120) and a second female connector (110) such that said direction control circuit unit (10) is connected to said manually operated switch device (101), said manually operated direction controller (102) and said conducting wires and connection lines extended from said hanger rod (82).

4. The direction control device for a ceiling fan as claimed in claim 2, wherein said direction control circuit unit (10) has a power circuit (13) for supplying power thereto, a detect circuit (14) for sensing signal received by said remote receiver (20), a microprocessor (15) connected to said detect circuit (14) for receiving control signal therefrom, and a relay drive circuit (16) controlled by the microprocessor (15), said relay drive circuit (16) being provided to control a switch circuit (160) having two relay switches operated synchronously, said two relay switches being connected to the coils of said motor (80) and input power thereby controlling the direction of current flow in the coils of said motor (80).

5. The direction control device for a ceiling fan as claimed in claim 3, wherein said direction control circuit unit (10) has a power circuit (13) for supplying power thereto, a detect circuit (14) for sensing signal received by said remote receiver (20), a microprocessor (15) connected to said detect circuit (14) for receiving control signal therefrom, and a relay drive circuit (16) controlled by the microprocessor (15), said relay drive circuit (16) being provided to control a switch circuit (160) having two relay switches operated synchronously, said two relay switches being connected to the coils of said motor (80) and input power thereby controlling the direction of current flow in the coils of said motor (80).

* * * * *